United States Patent [19]

Brodrib

[11] Patent Number: 4,816,002

[45] Date of Patent: Mar. 28, 1989

[54] AMBULATORY ANIMAL TOY

[76] Inventor: William A. Brodrib, 2700 SE. 7th Dr., Pompano Beach, Fla. 33062

[21] Appl. No.: 68,329

[22] Filed: Jul. 1, 1987

[51] Int. Cl.[4] ..... A63H 11/18; A63H 3/06

[52] U.S. Cl. ..... 446/373; 446/226; 446/317; 280/1.181

[58] Field of Search ..... 446/226, 312, 316, 317, 446/369, 370, 371, 373, 374, 375, 377; 280/1.165, 1.167, 1.181, 1.182, 1.192, 1.201, 1.204

[56] References Cited

U.S. PATENT DOCUMENTS

| | | | |
|---|---|---|---|
| 1,506,670 | 8/1924 | Sato et al. | 446/317 |
| 1,562,625 | 11/1925 | Fife | 446/226 |
| 1,599,290 | 9/1926 | Sato | 446/317 |
| 2,396,654 | 3/1946 | Herrmann | 446/370 |
| 2,636,317 | 4/1953 | Candee | 446/317 |
| 2,663,970 | 12/1953 | Brodrib | 446/317 |
| 2,824,409 | 2/1958 | Brodrib | 446/312 |
| 3,190,035 | 6/1965 | Armstrong | 446/364 |

FOREIGN PATENT DOCUMENTS

| | | | |
|---|---|---|---|
| 355789 | 8/1931 | United Kingdom | 446/226 |
| 651266 | 3/1951 | United Kingdom | 446/226 |
| 651110 | 3/1951 | United Kingdom | 446/226 |

*Primary Examiner*—Robert A. Hafer
*Assistant Examiner*—Charles H. Harris
*Attorney, Agent, or Firm*—Herbert L. Lerner; Laurence A. Greenberg

[57] ABSTRACT

An ambulatory animal toy includes a skeleton having a substantially horizontal spine with forward and rear ends defining forward and rear directions. Mutually spaced apart legs are attached to the spine and feet are attached to the legs. The feet are in frictional engagement with a walking surface and the spine can twist and bend substantially horizontally but is prevented from bending substantially vertically when the skeleton is pulled substantially in the forward direction.

20 Claims, 2 Drawing Sheets

Fig. 1
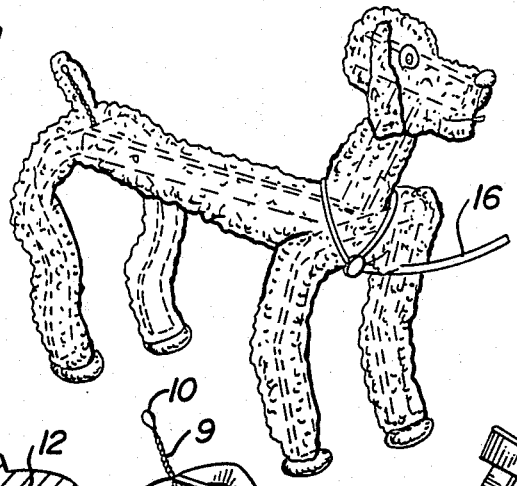
Fig. 3
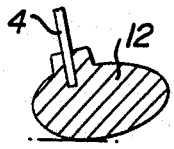
Fig. 4
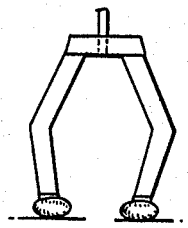
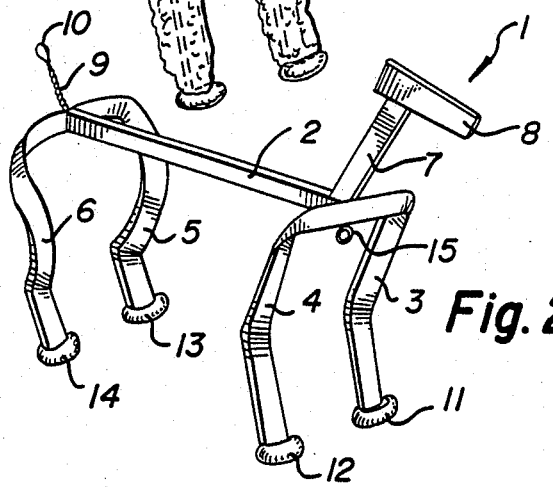
Fig. 2
Fig. 5a
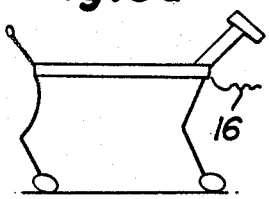
Fig. 6a
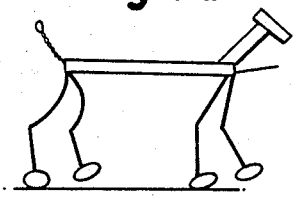
Fig. 7a
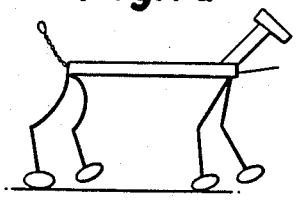
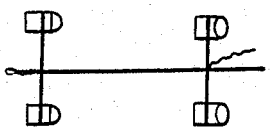
Fig. 5b
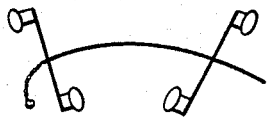
Fig. 6b
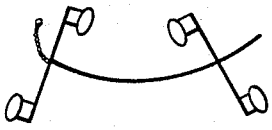
Fig. 7b

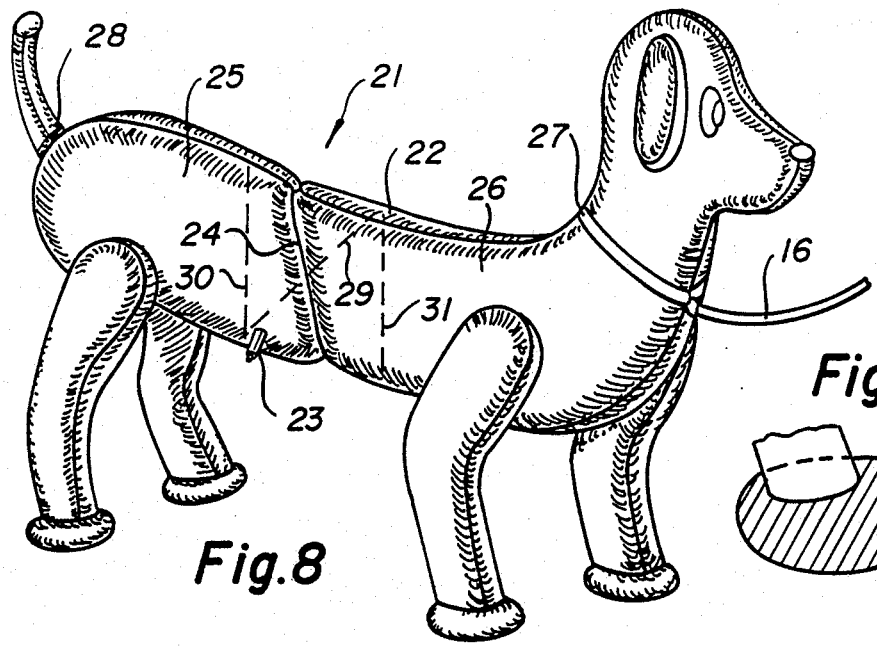
Fig.8
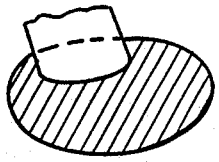
Fig.9
Fig.10a
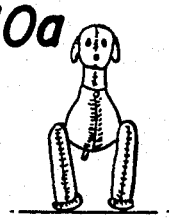
Fig.11a
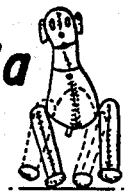
Fig.12a
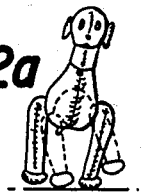
Fig.10b
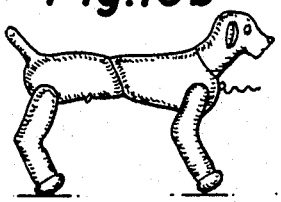
Fig.11b
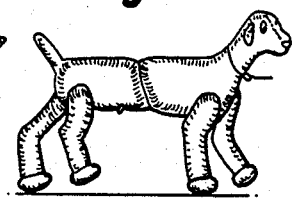
Fig.12b
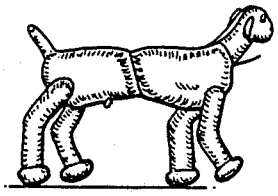
Fig.10c
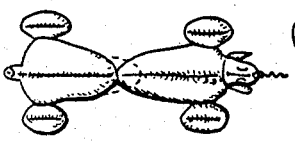
Fig.11c
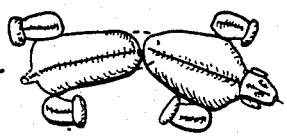
Fig. 12c
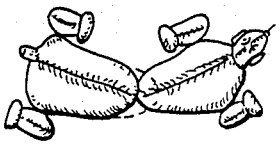

AMBULATORY ANIMAL TOY

The invention relates to an ambulatory animal toy and more specifically to such a toy which simulates the walking motion of a live animal when pulled due to cooperation between a resilient spine and feet of the toy with a surface being walked upon.

Various types of ambulatory animal toys and dolls are known from the prior art. One type concerns toys that roll on wheels, such as that disclosed in U.S. Pat. No. 2,896,948 invented by the owner of the instant application.

Another type concerns toys that rock, such as are disclosed in U.S. Pat. Nos. 2,727,741; 2,921,789 and 2,928,674.

In a further type of ambulatory toy, drive mechanisms cause the toy to walk or to simulate walking motion in the legs. Such devices are disclosed by U.S. Pat. Nos. 1,506,670; 1,721,577; 2,738,974; 2,829,466 and 3,125,829.

Yet another type of toy has resilient parts which tend to return to their original position when bent and released. U.S. Pat. Nos. 2,760,303; 4,341,036; 3,190,035; 2,824,409 and 2,663,970 exhibit such movement the latter of two of which were invented by the inventor of the instant application. The first two of these devices are merely toys having spines which will bend in any direction and return to their original shape, but are not pull toys and the third device has a spine that is inflexible.

Accordingly, only the last two devices are pull toys with resilient spines. In the device according U.S. Pat. No. 2,824,409, the toy leaps due to the fact that the spine bends severely vertically when pulled by a leash. The problem with this device is that it does not simulate a walking motion. In the device according U.S. Pat. No. 2,663,970 a better simulation of a walking motion is provided. However, it has been found to be difficult to operate the device correctly, especially for children. This is because the leash must be pulled with a force and at an angle that are limited to narrow ranges, or else the spine will bend vertically so far that the toy will lose its stability and fall over.

It is accordingly an object of the invention to provide an ambulatory toy animal, which overcomes the hereinaforementioned disadvantages of the heretofore-known devices of this general type and which will simulate walking motion while allowing the toy to be easily and reliably operated when pulled at a wide range of forces and angles.

With the foregoing and other objects in view there is provided, in accordance with the invention, an ambulatory animal toy, comprising an ambulatory animal toy, comprising a skeleton including a substantially horizontal spine having forward and rear ends defining forward and rear directions, mutually spaced apart legs attached to the spine, feet attached to the legs, means for causing friction between the feet and a walking surface, and means for causing the spine to twist and to bend substantially horizontally while preventing the spine from bending substantially vertically when the skeleton is pulled substantially in the forward direction.

The basis of the walking motion of the invention is that the lateral bending and twisting of the spine will allow the feet to walk, while the vertical rigidity thereof will prevent the toy from falling over.

In accordance with another feature of the invention, the legs have upper and lower portions and the lower portions are bent in the forward direction and in accordance with a further feature of the invention, the legs are in the form of pairs of legs each having upper and lower portions, and the lower portions of the legs of each pair are bent toward each other. In accordance with an added feature of the invention, the feet are at least partially formed of a weighted rubbery material forming the means for causing friction between the feet and a walking surface. These features help the toy to execute the walking motion.

In accordance with an additional feature of the invention, the spine and the legs of the skeleton are each formed of strips of inherently resilient material, such as spring steel or plastic, having a substantially rectangular cross section with wide and narrow surfaces, the wide surfaces of the spine being substantially vertical and the narrow surfaces of the spine being substantially horizontal forming the means for causing the spine to twist an to bend substantially horizontally while preventing the spine from bending substantially vertically.

In accordance with yet another feature of the invention, the skeleton includes a neck connected to the spine, and a head connected to the neck, the neck and the head are formed of strips of inherently resilient material having wide and narrow surfaces, and the wide surfaces of the neck face substantially laterally forming means for causing the neck to swing laterally when the skeleton is pulled.

In accordance with yet a further feature of the invention, there is provided a tail connected to the spine, and means for causing the tail to swing when the skeleton is pulled. In accordance with yet an added feature of the invention, the spine and the legs of the skeleton are each formed of strips of inherently resilient material having wide and narrow surfaces, and the wide surfaces of the legs face substantially in the forward direction forming means for causing the legs to swing forward and back when the skeleton is pulled.

The combination of the inherently resilient material and the fact that the material will not bend along the narrow surfaces thereof yet is able to twist, provides the basis for the walking motion of the ambulatory animal toy according to the invention.

With the objects of the invention in view, there is also provided an ambulatory toy animal wherein the skeleton is in the form of an inflatable skin, and the means for causing the spine to twist and to bend substantially horizontally while preventing the spine from bending substantially vertically are in the form a rib formed in the spine at an angle relative to the longitudinal axis of the spine.

In accordance with yet an added feature of the invention, the rib is disposed at an angle, preferably 45°, to the longitudinal direction of the spine. This feature provides the twisting and horizontal movement while preventing vertical movement.

In accordance with yet an additional feature of the invention, there is provided at least one other substantially vertical rib formed in the spine. This feature gives the spine a combination of movements.

In accordance with yet a further feature of the invention, the rib divides the spine into two portions and permits air to flow between the portions. The toy can therefore be inflated with just one valve.

In accordance with a concomitant feature of the invention, the skeleton includes a head and a tail having bases connected to the spine and two additional ribs each being disposed between a respective one of the bases and the spine. The head and tail will therefore also move as the skeleton is pulled.

Other features which are considered as characteristic for the invention are set forth in the appended claims.

Although the invention is illustrated and described herein as embodied in an ambulatory animal toy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a diagrammatic, perspective view of a first embodiment of the ambulatory animal toy according to the invention;

FIG. 2 is a perspective view of the skeleton of the device shown in FIG. 1;

FIG. 3 is an enlarged cross-sectional view of a foot of FIG. 2;

FIG. 4 is a fragmentary, front-elevational view of FIG. 2:

FIGS. 5*a* and 5*b*; 6*a* and 6*b* as well as 7*a* and 7*b* are, respective side-elevational and top-plan views on a reduced scale of the skeleton of FIG. 2 in different phases of a walking motion;

FIG. 8 is a view similar to FIG. 1 of a second embodiment of the ambulatory animal toy according to the invention;

FIG. 9 is an enlarged cross-sectional view of a foot of FIG. 8; and

FIGS. 10*a*, 10*b* and 10*c*; 11*a*, 11*b* and 11*c* as well as 12*a*, 12*b* and 12*c* are respective front-elevational, side-elevational and top-plan views on a reduced scale of the device of FIG. 8 in different phases of a walking motion;

Referring now to the figures of the drawings in detail and first, particularly, to FIG. 1 thereof, there is seen a perspective view of a first embodiment of the invention in the form of a stuffed pull toy animal. FIG. 2 shows the skeleton 1 of the stuffed animal, which is also shown in broken lines in FIG. 1.

The skeleton of the stuffed animal includes a substantially horizontal spine 2. A respective strip or piece of material is attached substantially perpendicularly to each end of the spine in order to provide the front and rear legs. Each strip is bent through approximately 90° in order to form two front legs 3, 4 and two rear legs 5, 6. The legs extend horizontally and then vertically downward from opposite ends of the spine 2 in order to minimize horizontal flexing and maximize stability. A neck 7 extends upward and forward from the front end of the spine and a head 8 is substantially perpendicular to the neck. The neck is formed of somewhat thinner material so that the head will move from side to side. A tail 9 has a weight 10 disposed thereon. Two front feet 11, 12 and two rear feet 13, 14 are attached to the respective feet. A hook 15 for a leash 16 is attached to the front legs.

Except for the tail 9, the skeleton is formed of strips of flat tempered spring steel which are approximately 0.020 inch thick and one inch wide. Plastic strips, formed of a material such as Lucite, which are approximately 3/16 inch thick and ¾ inch wide may also be used. These dimensions are suitable for a stuffed animal which is approximately 18 inches long but the dimensions should increased for larger toys and decreased for smaller toys, so that the weight of the toy will have the desired effect on the skeleton 1. The dimensions of the strips forming the skeleton permit the strips to bend along the wide surfaces thereof but prevent the strips from bending along the narrow surfaces thereof, while allowing a certain amount of tortional movement. Therefore, the spine 2 will bend and bounce back to its original position horizontally, but will not bend vertically. Similarly, the lower portion of the legs 3–6 will bend forward and back but not laterally. Finally, the neck 7 will bend laterally but not forward or back. The tail 9 will simply bounce in different directions because of the weight 10, so as to simulate a wagging tail.

The feet are convex and have slightly rounded bottoms which are tilted upward in front in order to help them to glide over rough surfaces. The feet are formed of a rubbery material such as vinyl, rubber or its generic equivalent and they weigh approximately 3–4 oz each. The combination of the material chosen for the feet and the weight thereof permit them to frictionally engage the floor rather than sliding, which is an integral part of the means for providing the walking motion of the toy, as will be explained below. The feet may be formed of a rubber body surrounding a lead weight, such as disclosed in U.S. Pat. No. 2,663,970.

The covering for the toy includes a skin formed of a suitable fabric and stuffing within the skin surrounding the skeleton, which are preferably flexible and give the stuffed animal the required shape. The skin may be glued to the feet or otherwise attached, such as is described in U.S. Pat. No. 2,663,970.

As can be seen from the front view of FIG. 4, the toy is slightly bow-legged and the feet are slightly pidgeon-toed which, along with the shape of the legs described above and the weight and frictional nature of the feet, give the legs a pendular or forward and backward swinging motion when the toy is pulled. Furthermore, the slight tortional motion of the spine causes a rocking effect wherein diagonally opposite feet to lift off the floor or walking surface when the toy is pulled.

In order to describe the simulated walking motion of the toy, reference will be made to FIGS. 5*a*–7*b*. The skeleton of the toy is a position of repose shown in side and top views in FIGS. 5*a* and 5*b*, before the leash 16 is pulled. As best understood, as the leash is pulled forward, the left front and right rear feet lose their frictional engagement with the floor or walking surface and snap forward due to the above-described pendular motion, while the other two feet actually move slightly backward. This can be seen by comparing the positions of the feet in FIGS. 6*a* and 6*b* with that shown in FIGS. 5*a* and 5*b*, relative to vertical and horizontal center lines shown in the figures. It is important to note that the spine in FIGS. 6*a* and 6*b* bends horizontally but not vertically. A slight tortional motion of the spine allows two diagonally opposite feet to rise above the floor or walking surface and the fact that the wide surfaces of the legs faces forward permits the two diagonally opposite legs to bend forward. Upon continued pulling on the leash, the left front and right rear feet frictionally engage the floor or walking surface at a new location, while the other two feet lose their frictional engagement due to the tortional motion described above and snap forward to a new position as seen in FIGS. 7*a* and 7b. These motions are repeated as the toy is pulled, simulating walking. The movement of the toy will simulate that of a trotting horse with diagonally opposite feet being lifted together, as oposed to a pacing horse.

In the embodiment of FIGS. 8–10 an inflatable pull toy 21 according to the second embodiment of the invention is shown. Contrary to the first embodiment, the toy 21 has no inner skeleton, but instead an outer skeleton or skin causes basically the same simulated walking motion. The outer skeleton has a spine 22. Similar to the first embodiment, the toy includes two front and two back legs each having a foot. Since the toy of the second embodiment is inflated from vinyl or a rubbery material such as rubber or its generic equivalent, it is much lighter than that of the first embodiment. It is therefore normally sufficient to use solid rubber feet glued to the legs as shown in FIG. 9 or slightly weighted inflated feet. A valve 23 is connected to the spine in order to inflate the entire toy. Seams are formed between the spine and the legs and between the legs and the feet, if inflatable feet are used, in the conventional manner, such as by fusing, heat sealing or gluing. The slightly forward bend of the legs and the slightly bow-legged or pidgeon-toed feet are similar to that shown for the first embodiment. However, the mechanism causing the walking motion is different.

As shown in FIG. 8, in inward crease or rib 24 divides the spine into two sections 25 and 26. The crease or rib is substantially in the middle of the back and is at approximately a 45° angle. The crease or rib is a location at which two pieces of skin are fused, glued or heat sealed together, except for a small opening which allows air to pass through. Therefore, the crease or rib extends all around the spine 22 but does not close off the interior of the spine and air will flow between the sections 25 and 26 when the toy is inflated. Similar creases 27 and 28 are also present at the base of the head and tail.

The simulated walking motion will now be described with the aid of FIGS. 10a–12c. The position of repose before the leash is pulled is seen in front-elevational, side-elevational and top-plan views in FIGS. 10a, 10b and 10c, respectively. When the leash is pulled, there is always a slight lateral component to the force on the leash, so that the crease or rib 24 causes the spine to bend and the sections 25 and 26 thereof move in opposite directions, into the position seen in FIG. 11c. The fact that the crease or rib 24 is disposed at an angle, preferably approximately a 45° angle, causes the left front and right rear feet to lose frictional contact, lift off the floor or walking surface and snap forward, into the position seen in FIGS. 11a, 11b and 11c. Upon continued pulling of the leash, the left front and right rear feet frictionally engage the floor or walking surface in a new position and the right front and left rear feet lose frictional engagement and snap forward into a new position seen in FIGS. 12a, 12b and 12c. This will provide a motion similar that executed by a trotting horse with diagonally opposite feet being lifted together, as opposed to the motion of a pacing horse. As the leash continues to be pulled the walking motion will continue with the toy executing a rocking motion, as seen by comparing FIGS. 10a, 11a and 12a. The creases or ribs 27 and 28 at the bases of the neck and tail cause the head to swing side to side and the tail to simulate a wagging motion as the toy walks. As with the first embodiment, it should be noted that the spine bends horizontally but not vertically.

If a crease or rib 29 is provided instead of the crease or rib 24, the same walking motion will take place, but the opposite feet will be lifted first. Furthermore, additional creases or ribs 30, 31 can be provided, which will add different wiggling motions as the toy walks.

I claim:

1. An ambulatory animal toy, comprising a skeleton including a substantially horizontal spine having forward and rear ends defining forward and rear directions, mutually spaced apart legs attached to said spine, feet attached to said legs, means for increasing friction between said feet and a walking surface, and means for causing said spine to twist and to bend substantially horizontally while preventing said spine from bending substantially vertically when said skeleton is pulled substantially in said forward direction, said means for causing said spine to twist and to bend substantially horizontally while preventing said spine from bending substantially vertically comprises at least one piece of material being inherently resilient in horizontal direction and inherently inflexible in vertical direction, thereby causing a more life-like ambulatory motion.

2. An ambulatory animal toy according to claim 1, wherein said legs have upper and lower portions and said lower portions are bent in said forward direction.

3. An ambulatory animal toy according to claim 1, wherein said legs comprise pairs of legs each having upper and lower portions, and said lower portions of said legs of each pair are bent toward each other.

4. An ambulatory animal toy according to claim 1, wherein said feet are comprised at least partially of a weighted rubbery material forming said means for causing friction between said feet and a walking surface.

5. An ambulatory animal toy, comprising a skeleton including a substantially horizontal spine having forward and rear ends defining forward and rear directions, mutually spaced apart legs attached to said spine, feet attached to said legs having frictional lower surfaces for contacting a walking surface, said spine and said legs of said skeleton each being formed of a respective strip of inherently resilient material having a substantially rectangular cross section with wide and narrow surfaces, said wide surfaces of said spine being substantially vertical and said narrow surfaces of said spine being substantially horizontal causing said spine to twist and to bend substantially horizontally while preventing said spine from bending substantially vertically when said skeleton is pulled substantially in said forward direction, said spine being inherently resilient in horizontal direction and inherently inflexible in vertical direction, thereby causing a more life-like ambulatory motion and said wide surfaces of said legs face substantially in said forward direction causing said legs to swing forward and back when said skeleton is pulled.

6. An ambulatory animal toy according to claim 1, wherein said skeleton includes a neck connected to said spine, and a head connected to said neck, said neck and said head are each formed of a respective strip of inherently resilient material having wide and narrow surfaces, and said wide surfaces of said neck face substantially laterally forming means for causing said neck to swing laterally when said skeleton is pulled.

7. An ambulatory animal toy according to claim 1, wherein said spine and said legs of said skeleton are each formed of a respective strip of inherently resilient material having wide and narrow surfaces, and said wide surfaces of said legs face substantially in said forward direction forming means for causing said legs to swing forward and back when said skeleton is pulled.

8. An ambulatory animal toy according to claim 7, wherein said legs have upper and lower portions and said lower portions are bent in said forward direction.

9. An ambulatory animal toy according to claim 7, wherein said legs are in the form of pairs of legs each having upper and lower portions, and said lower portions of said legs of each pair are bent toward each other.

10. An ambulatory animal toy according to claim 7, wherein said inherently resilient material is spring steel.

11. An ambulatory animal toy according to claim 7, wherein said inherently resilient material is plastic.

12. An ambulatory animal toy according to claim 1, wherein said spine and said legs of said skeleton comprise a respective strip of inherently resilient material having a substantially rectangular cross section with wide and narrow surfaces, said wide surfaces of said spine being substantially vertical and said narrow surfaces of said spine being substantially horizontal forming said means for causing said spine to twist and to bend substantially horizontally while preventing said spine from bending substantially vertically.

13. An ambulatory animal toy according to 12, wherein said inherently resilient material is spring steel.

14. An ambulatory animal toy according to claim 12, wherein said inherently resilient material is plastic.

15. An ambulatory animal toy according to claim 1, wherein said skeleton is in the form of an inflatable skin, and said means for causing said spine to twist and to bend substantially horizontally while preventing said spine from bending substantially vertically are in the form a rib formed in said spine at an angle relative to the longitudinal axis of said spine.

16. An ambulatory animal toy according to claim 15, wherein said rib is disposed at an angle to the longitudinal direction of said spine.

17. An ambulatory animal toy according claim 16, wherein said angle is substantially 45°.

18. An ambulatory animal toy according claim 15, including at least one other substantially vertical rib formed in said spine.

19. An ambulatory animal toy according to claim 15, wherein said rib divides said spine into two portions and permits air to flow between said portions.

20. An ambulatory animal toy according to claim 15, wherein said skeleton includes a head and a tail having bases connected to said spine and two additional ribs each being disposed between a respective one of said bases and said spine.

* * * * *